US012129682B2

(12) United States Patent
Leblouba et al.

(10) Patent No.: US 12,129,682 B2
(45) Date of Patent: Oct. 29, 2024

(54) PARTICLE-BASED ENERGY DISSIPATION DEVICE FOR STRUCTURES

(71) Applicant: University of Sharjah, Sharjah (AE)

(72) Inventors: Moussa Leblouba, Sharjah (AE); Mostafa Zahri, Sharjah (AE)

(73) Assignee: UNIVERSITY OF SHARJAH, Sharjah (AE)

( * ) Notice: Subject to any disclaimer, the term of this patent is extended or adjusted under 35 U.S.C. 154(b) by 0 days.

(21) Appl. No.: 18/171,051

(22) Filed: Feb. 17, 2023

(65) Prior Publication Data

US 2024/0279955 A1 Aug. 22, 2024

(51) Int. Cl.
*E04H 9/02* (2006.01)
*E04B 1/36* (2006.01)

(52) U.S. Cl.
CPC ..... *E04H 9/0215* (2020.05); *E04B 1/36* (2013.01)

(58) Field of Classification Search
CPC ..... E04H 9/0215; E04B 1/36
See application file for complete search history.

(56) References Cited

U.S. PATENT DOCUMENTS 4,195,111 A * 3/1980 Rautenbach ..... E04B 1/36 428/218
5,070,663 A * 12/1991 Sakai ..... F16F 15/023 52/167.2
10,294,618 B2 * 5/2019 Cho ..... E04H 9/021
10,669,734 B2 * 6/2020 Hejazi ..... E04H 9/0215
11,447,949 B2 * 9/2022 Honarbakhsh ..... E04H 9/0235
11,629,518 B2 * 4/2023 Malsch ..... E04H 9/16 52/167.2
2002/0129568 A1 * 9/2002 Oka ..... E04H 9/0237 52/167.3
2018/0245337 A1 * 8/2018 Malsch ..... F16F 7/1034
2018/0363254 A1 * 12/2018 Cho ..... E01D 19/041
2019/0323254 A1 * 10/2019 Hejazi ..... E04H 9/022
2021/0123257 A1 * 4/2021 Mohammadi Darani ..... F16F 7/09

(Continued)

OTHER PUBLICATIONS

S. W. Kim and K. H. Kim "Evaluation of structural behavior of hysteretic steel dampers under cyclic loading," Appl. Sci., vol. 10, No. 22, pp. 1-11, 2020, doi: 10.3390/app10228264.

(Continued)

*Primary Examiner* — Rodney Mintz
(74) *Attorney, Agent, or Firm* — MH2 Technology Law Group, LLP

(57) ABSTRACT

An energy dissipation device is disclosed. The device includes a container, where the container includes a top plate that is horizontally slotted on the container. In addition, the device includes at least one movable plate is inserted through a slot inside the container, and at least two holes inserted in the at least one movable plate. Moreover, the device includes at least two rods partially threaded at both sides of the container. In some implementations, the device may include a frame. In addition, the device includes a damper fixed inside the frame, and a plurality of braces installed in the frame to provide support to the damper. Moreover, the device includes at least one beam and at least one horizontal plate fixed to a bottom face of the at least one beam. A method of assembling an energy dissipation device is also disclosed.

18 Claims, 4 Drawing Sheets

(56) References Cited

U.S. PATENT DOCUMENTS

2021/0164223 A1* 6/2021 Honarbakhsh ..... E04B 1/98

OTHER PUBLICATIONS

M. Nath "Seismic Design and Performance of Yielding Shear Panel Device," 2016.
H. L. Hsu and H. Halim "Improving seismic performance of framed structures with steel curved dampers," Eng. Struct., vol. 130, pp. 99-111, 2017, doi: 10.1016/j.engstruct.2016.09.063.
D. R. Teruna, T. A. Majid, and B. Budiono "Experimental study of hysteretic steel damper for energy dissipation capacity," Adv. Civ. Eng., vol. 2015, No. Feb. 2015, doi: 10.1155/2015/631726.
Z. Yin, Z. Huang, H. Zhang, and D. Feng, "Experimental study on energy dissipation performance and failure mode of web-connected replaceable energy dissipation link," Appl. Sci., vol. 9, No. 15, 2019, doi: 10.3390/app9153200.

* cited by examiner

PARTICLE-BASED ENERGY DISSIPATION DEVICE FOR STRUCTURES

FIELD OF THE INVENTION

Embodiments of the present invention relate to the field of vibration control of civil structures and more particularly relate to an energy dissipation device based on particle damping.

BACKGROUND OF THE INVENTION

Natural disasters are catastrophic events with atmospheric, geological, and hydrological origins (e.g., droughts, earthquakes, floods, hurricanes, landslides) that can cause fatalities, property damage, and social environmental disruption.

Natural disasters pose a significant threat to structures and human lives. A substantial amount of seismic energy moves toward the structure through ground motion when earthquakes occur. This energy moves through the foundation to the superstructure members and dissipates through various mechanisms, such as the yielding of members and hysteresis, which can cause damage to those members and collapse the entire structure.

Many solutions are available to reduce the effect of natural disasters on structures as well as human lives. Energy dissipaters are used in different configurations in building and bridge structures. Bracings are also used with energy dissipaters. The bracings are used to provide lateral resistance against wind and/or earthquake loads, or between two adjacent structural members to absorb energy through a vertical shear sliding mechanism.

Seismic energy is the leading cause of building damage, and to protect structures, this energy must be redirected to another source or prevented from reaching the structure. There are many seismic control systems to be utilized, such as seismic resistance systems which allow the structure to absorb the energy but it results in huge environmental pollution and social costs due to the demolition, a seismic isolation system is another way to avoid damaging the structure since it separates the structure from the ground and makes it unaffected from the earthquake but it is costly to use on all structures and it is very hard to reinforce after earthquakes, a seismic damping system that absorbs the energy coming to the structure, and it is replaced after the device is damaged.

Many structural response control systems have been invented to reduce the amount of displacement or even acceleration that the structure undergoes whenever an earthquake occurs. These systems are categorized as active and passive control systems.

There are some traditional methods to make the structure capable of resisting seismic forces. These methods depend mainly on increasing the dimensions of the structural member (beams, columns, and shear walls). In contrast, structural response control systems don't affect the dimensions and the reinforcement in structural members. The above system utilizes an external device connected to specific locations on the structure, which increases the damping of the structure and helps it sustain the lateral loads.

Another example is US20180105135A1 discloses an energy dissipation device. The energy dissipation device having a longitudinal axis, with first and second members that are movable longitudinally relative to each other upon an axial load applied along the longitudinal axis of the device. A plurality of U-shaped flexural plates (UFPs) are arranged between the first and second members in the longitudinal direction of the device and operatively attached to the first and second members and configured to flex upon relative movement of the first and second members. An energy dissipation device may have at least one redundant yielding-type energy dissipater connected to one but not both first and second members.

But the above-disclosed patent has some disadvantages. The above device does not disclose a configuration that includes at least one movable plate that is inserted through a slot inside a container. The at least one movable plate is directly connected to an actuator. The above system does not include a damper that exhibits a force-displacement hysteresis loop by moving at least one beam from left to right or vice-versa. The device dissipated more energy if the force-displacement hysteresis loop gets wider. The above system only discloses the U-shaped flexural plates (UFPs) that are arranged between the first and second members in the longitudinal direction of the device.

Generally, the braces that are used in the above device structure do not have equal force in tension and compression, resulting in a phenomenon called 'overstrength of the brace'. Overstrength behavior may damage structural members or adjacent connections. To compensate, the connections and other structural members must incorporate an overstrength factor resulting in bigger sections, which increases the cost of the device However, such devices are costly and hard to manufacture at any workshop. The above device is either an active device or a passive device. Thus, it requires any source of power to operate it. Another disadvantage is the smoothness of the hysteresis loop. In compression, the corners of the hysteresis loop are not smooth and the damper that is used in the above-mentioned patent is not balanced, that is it is stronger in compression and weaker in tension. It is an object of at least preferred embodiments of the present invention to address and/or ameliorate at least one or more of the above-mentioned disadvantages and/or to at least provide the public with a useful alternative.

In order to overcome the aforementioned drawbacks, there is a need to provide a novel energy dissipation device that is cost-effective in nature that may be used as a solution for achieving a level of energy dissipation. Further, the device is passive in nature, thus, does not require any source of power to operate (e.g., electric power), and achieves good damping capacity.

SUMMARY OF THE INVENTION

An embodiment of the present disclosure relates to an energy dissipation device. The device includes a container, at least one movable plate, a slot, at least two holes, and at least two rods.

In accordance with an embodiment of the present invention, the container includes a top plate that is horizontally slotted on the container. The container is made of a welded thick steel plate. Further, the container is filled with a granular material that is any one of a particle, sand, aggregates of different sizes, or steel balls with specific diameters. The container is of any size and shape that is anyone of a rectangular shape, a cuboid shape, among others.

In accordance with an embodiment of the present invention, the energy dissipation device may also include the at least one movable plate that is inserted through the slot inside the container. The at least one movable plate is of any shape and size that is any one of a rectangular shape, a thick size, and a silhouette shape. The at least one movable plate includes a longitudinal part and a scoop part. Further, the at least two holes are mounted in the scoop part of the at least one movable plate through which the at least two rods are inserted.

The described implementations may also include one or more of the following features. The slot is of any shape and size that is anyone of a rectangular shape, a square shape, or a horizontal slot, among others.

In accordance with an embodiment of the present invention, the device may in addition include the at least two rods partially threaded at both sides of the container by using a plurality of bolts.

In accordance with an embodiment of the present invention, the energy dissipation device is used in many places like low-rise buildings or high-rise buildings, municipalities, road and transportation authorities, military (Ministry or Department of Defense), civil construction companies, and a railway department.

In accordance with an embodiment of the present invention, the energy dissipation device is a passive device that is designed to dissipate seismic energy directed to a structure with no need for an external energy source or active data collection in order to dissipate the seismic energy or isolate vibrations of ground from the structure. The passive device may either be applied to a new structure or an existing structure. Implementations of the described techniques may include hardware, a method or process, or a computer tangible medium.

Some implementations herein relate to a mechanism of fixing the energy dissipation device. The mechanism may include a frame. The mechanism may also include a damper fixed inside the frame by using a bolt arrangement.

In accordance with an embodiment of the present invention, the mechanism may furthermore include a plurality of braces installed in the frame to provide support to the damper. Further, the damper is any one of a friction damper, a viscous damper, a tuned mass damper, a tuned liquid damper, a metal yielding damper, and a base isolator (Elastomeric Bearings or Sliding Bearings).

In accordance with an embodiment of the present invention, the damper exhibits a force-displacement hysteresis loop, wherein the wider the force-displacement hysteresis loops more energy gets dissipated and vice-versa.

In accordance with an embodiment of the present invention, at least two braces from the plurality of braces are attached in an inverted V-shape manner inside the frame. The plurality of braces is installed in any manner either it is retrofitted in the frame, or a diagonal installed, an eccentrically installed, a horizontal installed, or a perpendicular installed.

In accordance with an embodiment of the present invention, the mechanism may in addition include at least one beam. The mechanism may moreover include at least one horizontal plate fixed to a bottom face of the at least one beam. Further, the at least one horizontal plate is of any shape and size that is anyone of a rectangular shape, a square shape, and a silhouette shape.

The described implementations may also include one or more of the following features. The energy dissipation device is configured by altering a size of the damper, changing the granular material to a more dissipative one, or using a deformable particle to achieve high energy dissipation and damping capabilities through the force-displacement hysteresis loop.

In accordance with an embodiment of the present invention, the energy dissipation device is a multi-performance device, wherein a behavior of the energy dissipation device varies depending on the force-displacement hysteresis loop.

The foregoing objectives of the present invention are to provide a feasible energy dissipation device that is easily configured to suit a wide array of applications. This device is cheap, easy to manufacture at any workshop, and its constituting parts may easily be obtained from any hardware shop. Further, this device is capable to dissipate energy under small as well as large displacement amplitudes. Therefore, it is used for applications where small vibrations are anticipated (e.g., in buildings subjected to minor to moderate winds and man-made vibrations such as the case of train-induced vibrations) as well as in case of large vibrations (e.g., strong wind loads and strong earthquake ground motions).

BRIEF DESCRIPTION OF THE DRAWINGS

So that the manner in which the above recited features of the present invention is be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

ELEMENT LIST

Figure 1:
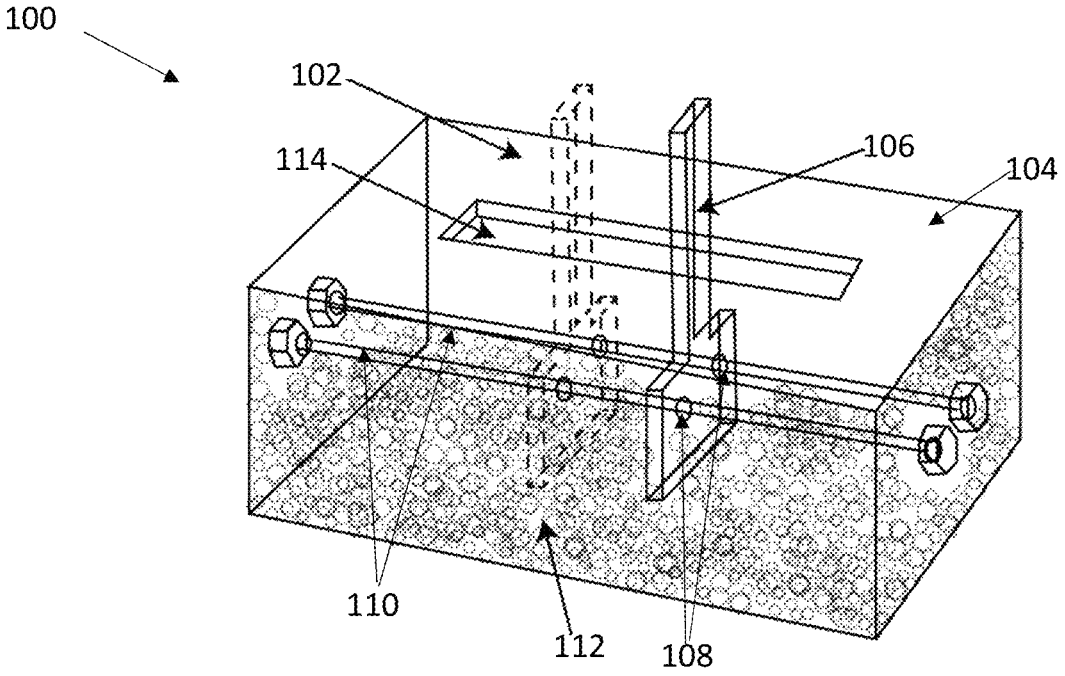
FIG. 1 depicts a perspective view of an energy dissipation device, according to an embodiment of a present invention.

Container 102
Top plate 104
At least one movable plate 106
At least two holes 108
At least two rods 110
Granular material 112
Slot 114
Frame 202
Plurality of braces 204
At least one beam 206
Damper 208
At least one horizontal plate 210

DETAILED DESCRIPTION

The present invention relates to an energy dissipation device. The energy dissipation device is a mechanical device and does not require any source of power to operate. It is capable of dissipating vibration energies through hysteresis or hysteresis and viscoelasticity. The behavior of the new damper is rate-dependent, and it is capable to operate at different loading rates. It has many applications, including but not limited to buildings to dissipate energy imparted by earthquakes and wind loads and railways.

The principles of the present invention and their advantages are best understood by referring to FIGS. 1-6. In the following detailed description of illustrative or exemplary embodiments of the disclosure, specific embodiments in which the disclosure may be practiced are described in sufficient detail to enable those skilled in the art to practice the disclosed embodiments. The following detailed description is, therefore, not to be taken in a limiting sense, and the scope of the present disclosure is defined by the appended claims and equivalents thereof. References within the specification to "one embodiment," "an embodiment," "embodiments," or "one or more embodiments" are intended to indicate that a particular feature, structure, or characteristic described in connection with the embodiment is included in at least one embodiment of the present disclosure.

FIG. 1 depicts a perspective view of an energy dissipation device (100), according to an embodiment of a present invention. The energy dissipation device (100) includes a container (102), at least one movable plate (106), a slot (114), at least two holes (108), and at least two rods (110).

In accordance with an embodiment of the present invention, the container (102) includes a top plate (104) that is horizontally slotted on the container (102). The container (102) is made of a welded thick steel plate. Further, the container (102) is filled with a granular material (112) that is any one of a particle, sand, aggregates of different sizes, or steel balls with specific diameters. The container (102) is of any size and shape that is anyone of a rectangular shape, a cuboid shape, among others.

In accordance with an embodiment of the present invention, the energy dissipation device (100) may also include the at least one movable plate (106) that is inserted through the slot (114) inside the container. The at least one movable plate (106) is of any shape and size that is any one of a rectangular shape, a thick size, and a silhouette shape. The at least one movable plate (106) includes a longitudinal part and a scoop part. Further, the at least two holes (109) are mounted in the scoop part of the at least one movable plate (106) through which the at least two rods (110) are inserted.

The described implementations may also include one or more of the following features. The slot (114) is of any shape and size that is anyone of a rectangular shape, a square shape, or a horizontal slot, among others.

In accordance with an embodiment of the present invention, the device (100) may in addition include the at least two rods (110) partially threaded at both sides of the container by using a plurality of bolts. The plurality of bolts is any one of a carriage bolt, a U-bolt, an anchor bolt, or an eye bolt, among others.

In accordance with an embodiment of the present invention, the energy dissipation device (100) is used in many places like low-rise buildings or high-rise buildings, municipalities, road and transportation authorities, military (Ministry or Department of Defense), civil construction companies, and a railway department.

In accordance with an embodiment of the present invention, the energy dissipation device (100) is a passive device that is designed to dissipate seismic energy directed to a structure with no need for an external energy source or active data collection in order to dissipate the seismic energy or isolate vibrations of a ground from the structure. The passive device may either be applied to a new structure or an existing structure. Implementations of the described techniques may include hardware, a method or process, or a computer tangible medium.

In accordance with an advantageous embodiment of the present invention, the passive devices are relatively inexpensive compared to an active control device, and they may be easily replaced if damaged with minimal cost and time.

Figure 2:
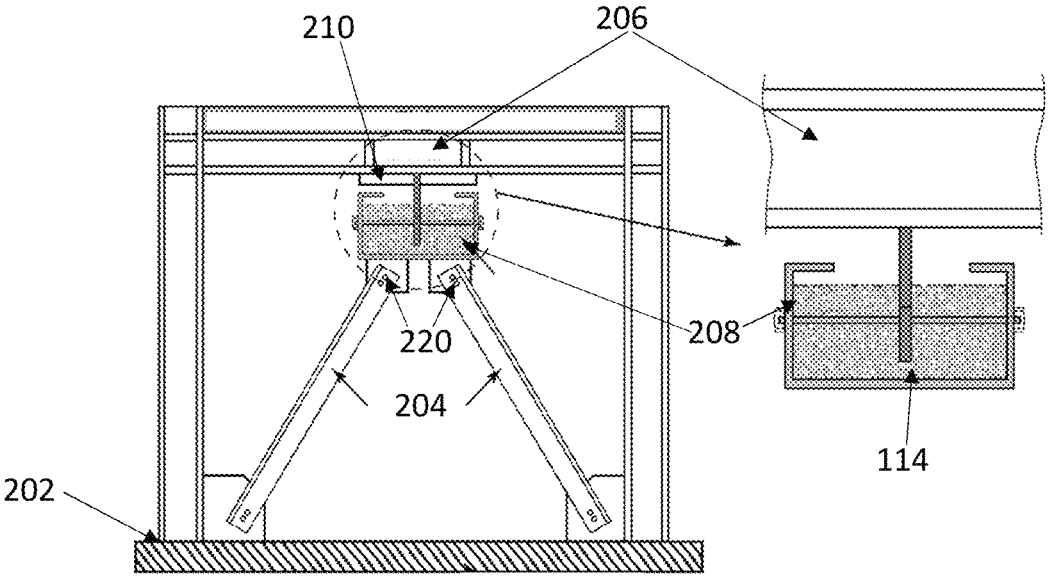
FIG. 2 shows how the proposed damper should be attached to the frame, according to an embodiment of the present invention.

FIG. 2 shows how the proposed damper should be attached to the frame, according to an embodiment of the present invention. Some implementations herein relate to a mechanism of fixing the energy dissipation device. The mechanism may include a frame (202). The mechanism may also include a damper (208) fixed inside the frame (202) by using a bolt arrangement (220).

In accordance with an embodiment of the present invention, the mechanism may furthermore include a plurality of braces (204) installed in the frame (202) to provide support to the damper (208). Further, the damper (208) is any one of a friction damper, a viscous damper, a tuned mass damper, a tuned liquid damper, a metal yielding damper, and a base isolator (Elastomeric Bearings or Sliding Bearings).

In accordance with an embodiment of the present invention, the mechanism may in addition include at least one beam (206). The mechanism may moreover include at least one horizontal plate (210) fixed to a bottom face of the at least one beam (206). Further, the at least one horizontal plate (210) is of any shape and size that is anyone of a rectangular shape, a square shape, and a silhouette shape.

In accordance with an embodiment of the present invention, the damper (208) is supported by the plurality of braces (204). In accordance with an embodiment of the present invention, at least two braces (204) from the plurality of braces (204) are attached in an inverted V-shape manner inside the frame (202). The plurality of braces (204) is installed in any manner either it is retrofitted in the frame, or a diagonal installed, an eccentrically installed, a horizontal installed, or a perpendicular installed.

In accordance with an embodiment of the present invention, when the frame is subjected to a lateral dynamic force (e.g., due to wind or earthquakes), the at least one beam (206) moves horizontally along with the at least one movable rectangular steel plate (106). This causes the granular material (114) (refer to FIG. 1) inside the container (102) to be compressed to one side of the container (102), thus, facing a resistive dampening force. When the dynamic force changes its direction, the at least one beam (206) moves in the same direction and so do at least one movable rectangular steel plate (106), causing the granular material (114) to be forced to moved and compressed, thus providing the resistive damping force.

In accordance with an embodiment of the present invention, the damper (208) exhibits a force-displacement hysteresis loop, wherein a wider the force-displacement hysteresis loops more energy gets dissipated and vice-versa.

The described implementations may also include one or more of the following features. The energy dissipation device (100) (refer to FIG. 1) is configured by altering a size of the damper (208), changing the granular material (114) to a more dissipative one, or using a deformable particle to achieve high energy dissipation and damping capabilities through the force-displacement hysteresis loop.

In accordance with an embodiment of the present invention, the energy dissipation device (100) (refer to FIG. 1) is a multi-performance device, wherein a behavior of the energy dissipation device varies depending on the force-displacement hysteresis loop.

Figure 3A:
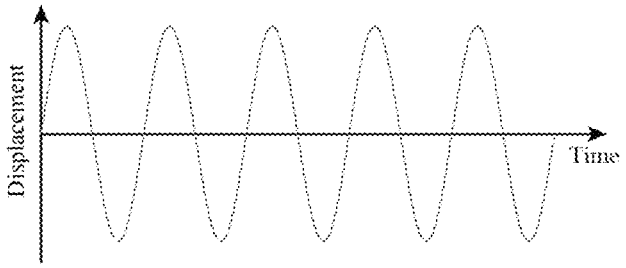
FIG. 3A and FIG. 3B show an applied displacement and a recorded force time hysteresis loop, according to an exemplary embodiment of the present invention.
Figure 3B:
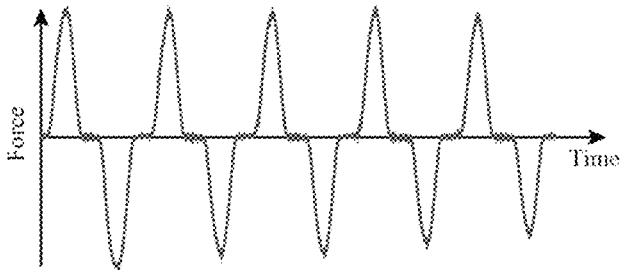

FIG. 3A and FIG. 3B show an applied displacement and a recorded force time hysteresis loop, according to an exemplary embodiment of the present invention. FIG. 3A shows an input displacement and FIG. 3B shows an output force applied to the damper (208) (refer to FIG. 2). Since only a primitive prototype is fabricated, the energy dissipation device (100) (refer to FIG. 1) is fabricated using a primitive setup made of steel plates welded together to make the container (102) (refer FIG. 1) (missing the top plate) and the silhouette plate is the rectangular thick movable steel plate (106) (refer FIG. 1) that is attached directly to an actuator. In the embodiment, the force response is nonlinear, suggesting energy is being absorbed through hysteresis.

Figure 4A:
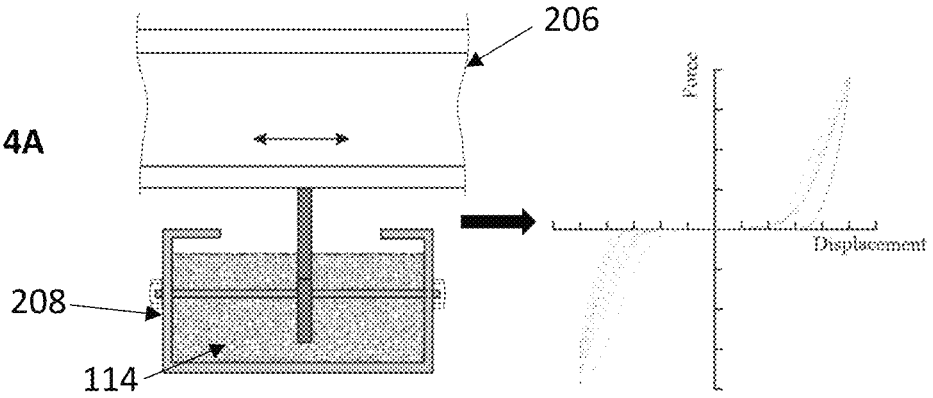
FIGS. 4A-4D illustrate a mechanism of work of the energy dissipation device inside a frame, according to another embodiment of the present invention.
Figure 4B:
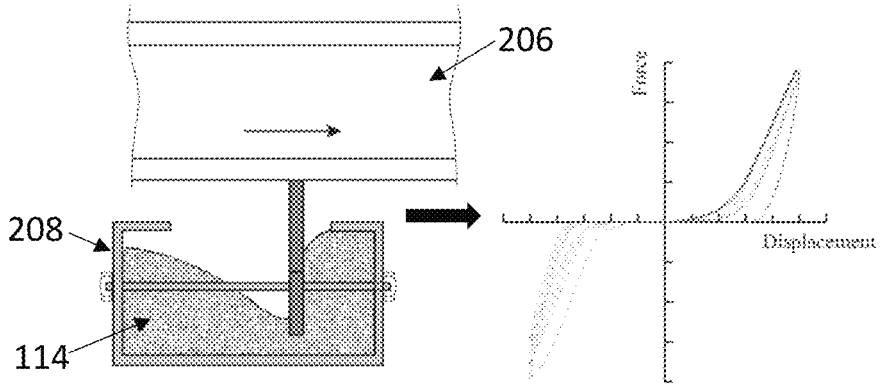
Figure 4C:
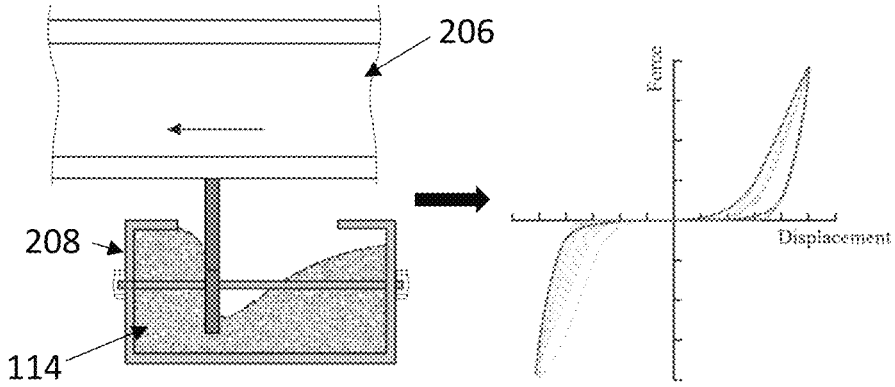
Figure 4D:
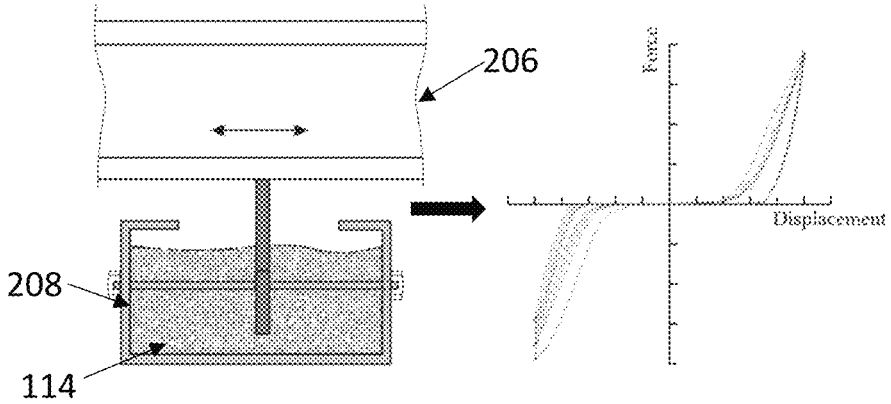

FIGS. 4A-4D illustrate the mechanism of work of the energy dissipation device (100) (refer to FIG. 1) inside the frame (202) (refer to FIG. 2), according to another embodiment of the present invention. FIGS. 4A-4D show the at least one beam (206) (refer to FIG. 2) and the damper (208). When subjected to external loading, the at least one beam (206) moves in the lateral direction, either left or right. This movement causes the inserted the at least one movable plate (106) to move along with at least one beam (206) and compress the granular/particle material (114). When compressed, the restoring force increases as shown in FIG. 4B. As the load reverses direction (i.e., the at least one beam (206) moves to the left), the compressed granular material (114) loosens resulting in the hysteresis loop due to the deformation of the granular material (114). As the load increases in the same direction, the at least one movable plate (106) pushes and compresses again the granular material (114) to the left side of the container (102), resulting in an increase in resistance against the compressive forces as shown in FIG. 4C. As the load continues to push the at least one beam (206) left and right, the damper (208) exhibits the hysteresis behavior, as shown in FIG. 4D.

Figure 5:
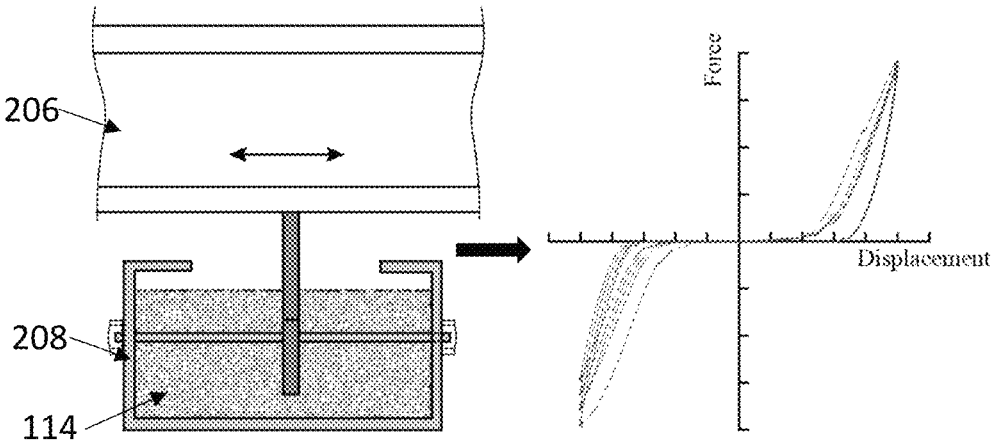
FIG. 5 shows a beam-damper mechanism at the end of the test along with the complete force-displacement hysteresis loop, according to another exemplary embodiment of the present invention.

FIG. 5 shows a beam-damper mechanism at the end of the test along with the complete force-displacement hysteresis loop, according to another exemplary embodiment of the present invention. An area under the loop indicates the amount of energy dissipated through hysteresis. It is important to understand that the material inside the container loses its stiffness (i.e., zero resistance) due to the left gap when the granular material (114) (refer to FIG. 1) particles are compressed on one side, thus leaving a gap behind the granular material (114). This gap gets filled upon load reversal (i.e., particle re-distribution). This phenomenon is shown in FIGS. 4B-4C.

In accordance with an embodiment of the present invention, the rate at which the load is applied has an effect on the shape and size of the hysteresis loop, which in turn has an effect on the amount of resistance, stiffness, and energy dissipation capacity. Therefore, both the stiffness and damping are load rate dependent.

Figure 6:
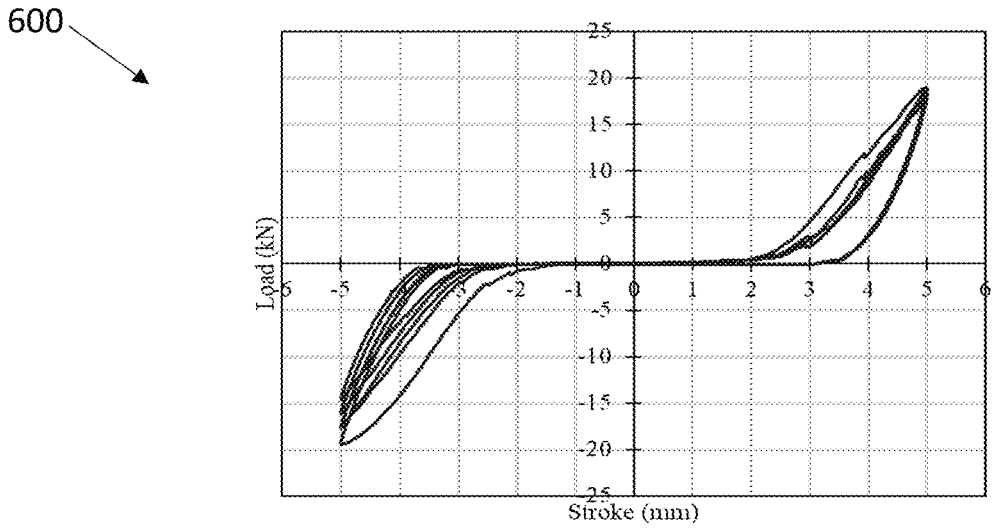
FIG. 6 illustrates the force-displacement hysteresis loop, according to another exemplary embodiment of the present invention.

FIG. 6 illustrates the force-displacement hysteresis loop (600), according to another exemplary embodiment of the present invention. A primitive prototype is fabricated by using a steel container (102) (refer to FIG. 1) and at least one rectangular movable plate (106). The test is conducted by using an Instron actuator of 100 kN capacity. FIG. 6 shows the resulting load-stroke hysteresis loop. Clearly, the curve is almost symmetric, suggesting its stability. The test is conducted at a 5 mm/s loading rate.

In accordance with another advantageous embodiment of the present invention, the device (100) (refer to FIG. 1) is configured with the damper (208) (refer to FIG. 2) to achieve increased friction and damping with increased movement amplitude, and the device (100) is configured to employ different device configurations to suit different types and magnitudes of loads.

In accordance with another advantageous embodiment of the present invention, the configuration of the device (100) (refer FIG. 1) includes the size of the container (102), the length of the slot (114), the number of at least one movable rectangular steel plates (106), the position of the device (100) itself, and the granular material (114) type. With these configurations, one may achieve greater energy dissipation while accommodating small and large displacement amplitudes and loading speeds.

In accordance with another advantageous embodiment of the present invention, the energy dissipation device (100) (refer FIG. 1) is easily configured to suit a wide array of applications. This device (100) is cheap and easy to manufacture at any workshop, and its constituting parts may easily be obtained from any hardware shop. Further, this device is capable to dissipate energy under small as well as large displacement amplitudes. Therefore, it is used for applications where small vibrations are anticipated (e.g., in buildings subjected to minor to moderate winds and man-made vibrations such as the case of train-induced vibrations) as well as in case of large vibrations (e.g., strong wind loads and strong earthquake ground motions).

Therefore, the invention may be applied to underground foundation engineering support, building brick wall structures, light floor slabs and roofs, members with the characteristics of fire prevention, water resistance, vibration reduction, noise reduction, heat insulation, and the like, energy dissipation members of slope protection engineering and the like.

In accordance with another advantageous embodiment of the present invention, the preparation process of the present invention is simple, and the structure is understood and easy to install. The present invention mixes the advantage of utilizing a particle-damping device that increases the vibration-damping frequency band and strengthens the passive energy dissipation effect. The present invention is not limited to the fundamental frequency vibration damping and high order of frequency. The device is also effective in vibration suppression. The present invention provides structure and vibration control more effectively, and it is more reliable.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. An energy dissipation device, comprising:

a damper comprising:

a closed container composed of a welded plate material, wherein the container includes a top plate that is horizontally slotted and wherein the container is filled with a granular material;

at least one movable plate inserted through the horizontal slot and extending inside the container;

at least two holes located in a lower portion of the at least one movable plate; and at least two rods partially threaded at opposing sides of the container and inserted through the at least two holes;

wherein the damper is fixed inside a frame using a bolt arrangement, at least two braces of a plurality of braces are attached to the damper in an inverted V-shaped configuration inside the frame, at least one beam is horizontally positioned inside a top portion of the frame, the at least one beam having at least one horizontal plate fixed to a bottom surface thereof, wherein an upper portion of the at least one movable plate is fixed to the bottom surface of the at least one beam such that the at least one movable plate and the at least one beam are configured to move simultaneously in a lateral direction.

2. The energy dissipation device as claimed in claim 1, wherein the welded plate material is a welded thick steel plate.

3. The energy dissipation device as claimed in claim 1, wherein the granular material is any one of a particle, sand, aggregates of different sizes, or steel balls with specific diameters.

4. The energy dissipation device as claimed in claim 1, wherein the container is of any size and shape that is any one of a rectangular shape, or a cuboid shape.

5. The energy dissipation device as claimed in claim 1, wherein the slot is of a shape and size that is any one of a rectangular shape, a square shape, or a horizontal slot.

6. The energy dissipation device as claimed in claim 1, wherein the movable plate is of any shape and size that is any one of a rectangular shape, a thick size, and a silhouette shape.

7. The energy dissipation device as claimed in claim 1, wherein the at least one movable plate includes a longitudinal part and a scoop part.

8. The energy dissipation device as claimed in claim 1, wherein the at least two holes are mounted in the scoop part of the at least one movable plate through which the at least two rods are inserted.

9. The energy dissipation device as claimed in claim 1, wherein the at least two rods are partially threaded at both of the sides of the container by using a plurality of bolts.

10. The energy dissipation device as claimed in claim 1, wherein the energy dissipation device is a passive device that is designed to dissipate seismic energy directed to a structure with no need for an external energy source or active data collection in order to dissipate the seismic energy or isolate vibrations of a ground from the structure.

11. The energy dissipation device as claimed in claim 10, wherein the passive device is either be applied to a new structure or an existing structure.

12. A method of assembling an energy dissipation device, comprising the steps of:

providing the energy dissipation device as claimed in claim 1;

fixing the damper inside the frame;

installing the plurality of braces in the frame to provide support to the damper;

fixing the at least one beam to move in the lateral direction, and fixing the at least one horizontal plate to the bottom surface of the at least one beam.

13. The method of assembling an energy dissipation device as claimed in claim 12, wherein the at least one horizontal plate is of rectangular shape, a square shape, or a silhouette shape.

14. The method of assembling an energy dissipation device as claimed in claim 12, wherein the damper is any one of a friction damper, a viscous damper, a tuned mass damper, a tuned liquid damper, a metal yielding damper, or a base isolator.

15. The method of assembling an energy dissipation device as claimed in claim 12, wherein the damper exhibits a force-displacement hysteresis loop, wherein wider the force-displacement hysteresis loops, the more energy gets dissipated and vice-versa.

16. The method of assembling an energy dissipation device as claimed in claim 12, wherein the energy dissipation device is configured by altering a size of the damper, changing the granular material to a more dissipative one, or using a deformable particle to achieve high energy dissipation and damping capabilities through the force-displacement hysteresis loop.

17. The method of assembling an energy dissipation device as claimed in claim 12, wherein the plurality of braces is either retrofitted in the frame or diagonally, eccentrically, horizontally or perpendicularly installed.

18. The method of assembling an energy dissipation device as claimed in claim 12, wherein the energy dissipation device is a multi-performance device, wherein behavior of the energy dissipation device varies depending on the force-displacement hysteresis loop.

* * * * *